United States Patent [19]

De Nicola et al.

[11] 3,992,768

[45] Nov. 23, 1976

[54] METHOD AND APPARATUS FOR AUTOMATICALLY STAPLING TAPE

[75] Inventors: Frank De Nicola; G. Edward Vallender, both of Visalia, Calif.

[73] Assignee: Berryfast, Inc., Tulare, Calif.

[22] Filed: Feb. 19, 1975

[21] Appl. No.: 551,144

Related U.S. Application Data

[60] Continuation of Ser. No. 375,803, July 2, 1973, abandoned, which is a division of Ser. No. 201,034, Nov. 22, 1971, Pat. No. 3,771,708.

[52] U.S. Cl. ..... 29/429

[51] Int. Cl.[2] ..... B27F 7/22

[58] Field of Search ..... 29/429; 227/110, 111, 227/120, 130, 156; 93/36.9

[56] References Cited

UNITED STATES PATENTS

| | | | |
|---|---|---|---|
| 2,915,754 | 12/1959 | Wandel | 227/111 |
| 3,272,267 | 9/1966 | Langas | 227/130 |
| 3,283,986 | 11/1966 | McKee | 227/120 |
| 3,291,356 | 12/1966 | Armstrong | 227/156 |
| 3,310,215 | 3/1967 | Bostick | 227/111 |
| 3,476,302 | 11/1969 | Hurd | 227/120 |
| 3,796,365 | 3/1974 | Downing | 227/111 |

*Primary Examiner*—C.W. Lanham
*Assistant Examiner*—Dan C. Crane
*Attorney, Agent, or Firm*—Robert R. Thornton

[57] ABSTRACT

Sheet material is fastened to a base by means of a tape which is extended along the sheet material. Staples are periodically and automatically driven through the sheet material into the base so as to enclose the tape, thereby fastening the tape and the sheet material to the base. The tape is in the form of a continuous strip.

1 Claim, 12 Drawing Figures

FIG. 12
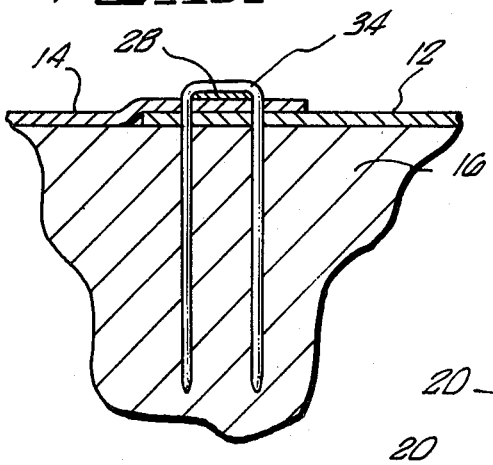
FIG. 4
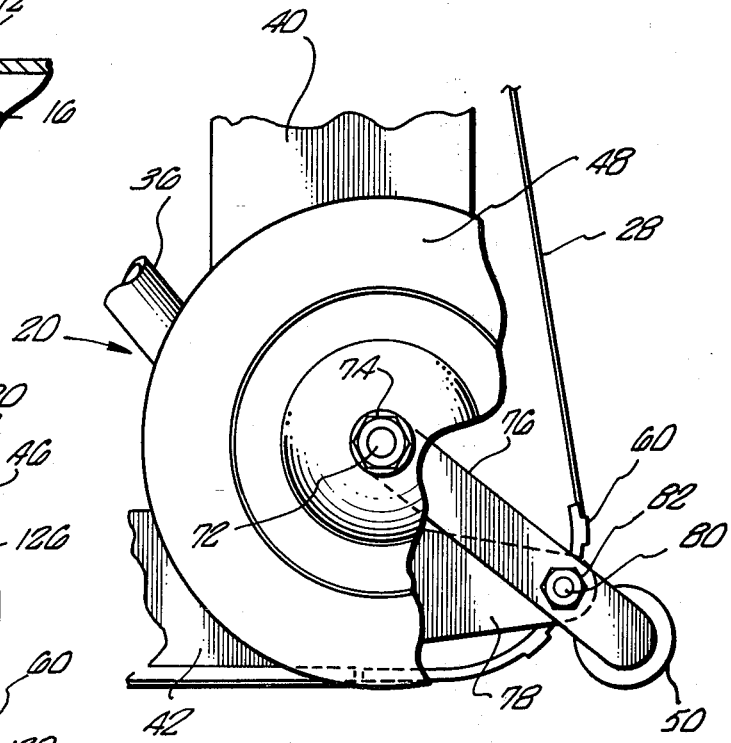
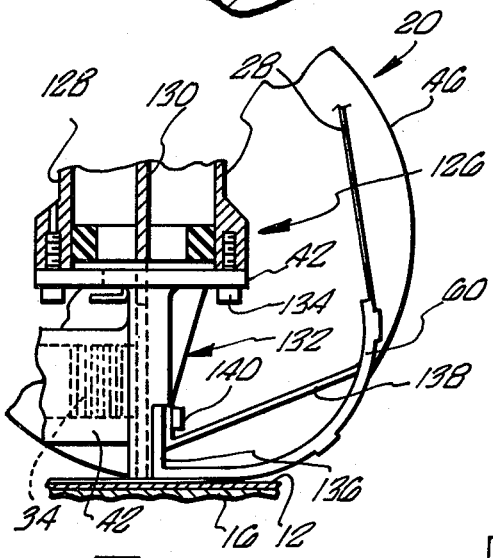
FIG. 9
FIG. 3
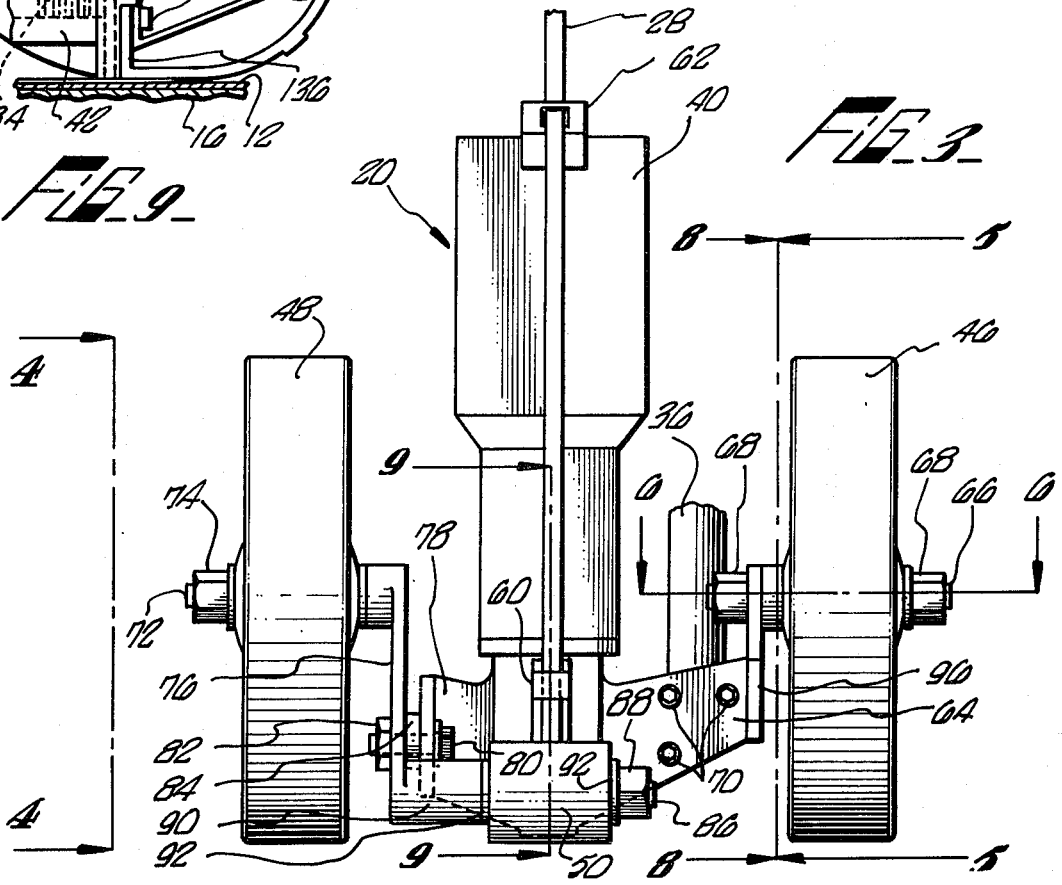

METHOD AND APPARATUS FOR AUTOMATICALLY STAPLING TAPE

CROSS-REFERENCES TO RELATED APPLICATIONS

This is a continuation, of application Ser. No. 375,803, filed July 2, 1973, now abandoned, is a division of co-pending U.S. Pat. Application Ser. No. 201,034, filed Nov. 22, 1971, now U.S. Pat. No. 3,771,708.

BACKGROUND OF THE INVENTION

1. Field of the Invention

This invention relates to method and apparatus for attaching sheet material, and more particularly roofing sheet material, to a base, or roof, and the product thereof.

2. Description of the Prior Art

Sheet roofing materials, such as asphalt treated paper, felt, and the like, have long been in use as a covering for a bare roof surface, prior to the application to the roof surface of a weather proofing material, such as asphalt. Sheet materials are conventionally laid out upon a roof in strips so as to overlap at their edges. In order to hold the sheets to the roof, it is necessary to attach the sheets together at the overlapping edges and, in addition, where the sheets are of a substantial width, to attach the individual sheets themselves to the roof between adjacent edge attachments. While a variety of systems have been utilized for making this attachment, the system generally used at present is to place a thin metal disc at the point of attachment, and drive a nail through the disc into the roof surface. The disc provides an extended head area for the nail, so as to inhibit the sheet material from being pulled away from the nail itself. Because of the tearing characteristics of the sheet material, rips often occur between adjacent points of attachment, either during working upon the roof prior to the weather proofing material application, or by reason of wind and the like. Furthermore, manual nailing of the discs to the sheet material is laborious, time consuming and expensive.

SUMMARY

The present invention has method, apparatus, and product aspects. In its method aspect, the invention generally comprises providing a moveable frame having connected thereto a continuous strip of narrow flexible tape which may be supplied in the form of a coil attached to the frame so as to be rotatable about the coil axis, and a stapling machine having a stapler head, passing the tape beneath the stapler head, moving the frame along sheet material which rests on a base so that the stapler head is immediately adjacent the sheet material, periodically actuating the stapling machine to staple the tape to the base through the sheet material while so moving the frame along the sheet material, and continuously pulling tape from the tape supply by means of the successively last applied staple as the frame is moved along the sheet material during the periodic stapling.

In its product aspect, the present invention generally comprises a base having sheet material attached thereto by means of a plurality of generally parallel tapes which are spaced one from another and overlying the sheet material so as to be separated from the base thereby, and a plurality of staples spaced along the tapes so as to enclose the tape and extend through the sheet material into the base, thereby holding the sheet material to the base and providing, by reason of the parallel tapes, resistance against tearing or removal of the sheet material between the staples along the lengths of the tapes.

In its apparatus aspects, the present invention generally comprises a frame, a source of narrow flexible tape connected to the frame, wheel means attached to the frame so that the frame may be rolled along a surface so as to move the tape along the surface, a stapling machine attached to the frame and having a stapler head disposed so as to be immediately adjacent the surface upon which the frame is being rolled, tape guide means for guiding tape from the source past the stapler head, a source of staples, means for feeding the staples to the stapler head so that a staple is driven into the surface so as to enclose the tape when the stapling machine is actuated, and means for periodically actuating the stapling machine.

BRIEF DESCRIPTION OF THE DRAWING

The invention may be more readily understood by referring to the accompanying drawing in which:

FIG. 3 is a front elevation of a portion of the apparatus illustrated in FIG. 2;

FIG. 4 is a view, partially broken away, taken along lines 4—4 of FIG. 3;

FIG. 9 is a partial sectional view taken along lines 9—9 of FIG. 3;

FIG. 12 is a partial sectional view illustrating a portion of the product of the present invention.

DESCRIPTION OF THE PREFERRED EMBODIMENTS

Figure 1:
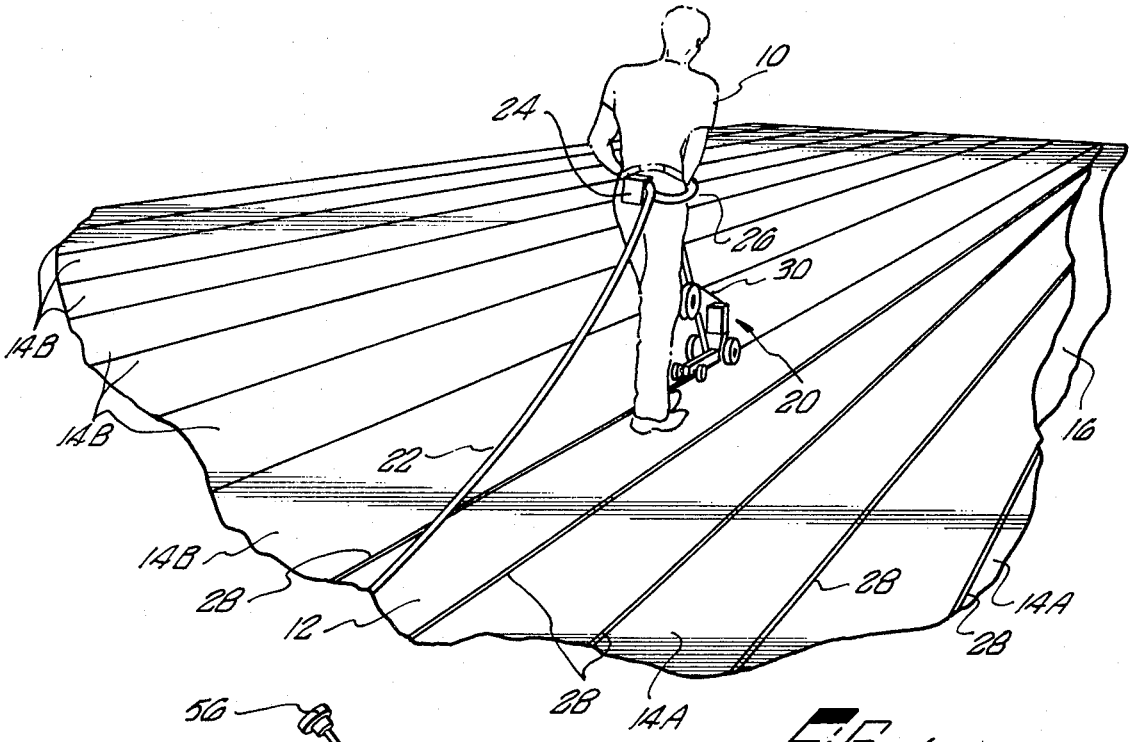
FIG. 1 is a view of the apparatus and product of the present invention, illustrating the method of practice thereof.

Referring now to FIG. 1, there is shown an operator 10 walking along sheet material 12 in the form of an elongated rectangular strip. Adjacent the sheet material 12 are additional units of sheet material 14A, 14B. The sheets 12, 14A, 14B are supported on a base 16. For purposes of explanation, the sheets 12 and 14 may be considered to be roofing paper, and the base 16 to be a bare roof, awaiting the application of some type of weather proofing. The operator 10 is pushing a tape stapler 20 over the sheet material 12, 14. The tape stapler 20 is actuated by compressed air from a compressed air source (not shown) which supplies air through an air hose 22 to a compressed air junction box 24 which is strapped to the back of the operator 10. From the compressed air junction box a compressed air transfer hose 26 extends around to the front of the operator for applying compressed air to the tape stapler 20. In FIG. 1, the sheets 12 and 14A have been attached to the base 16 by means of staples (not shown due to size) which have been driven through the sheets 12, 14A so as to enclose tapes 28, which have been unrolled from a coil of tape 30 carried by the tape stapler 20 and stapled to the base through the sheet material by the tape stapler 20. As seen in FIG. 1, the tapes 28 are generally laid out in parallel relationship to one another. By a comparison of the width of the sheet materials 14A, 14B, 12 and the laterial spacing of the tapes 28, it will be apparent that certain tapes overlay the overlap between adjacent pieces of sheet material and other tapes extend generally down the central portion of the sheets. As will be explained hereinafter, this type of tape spacing provides additional fastening strength for fastening the sheet material to the base.

Figure 2:
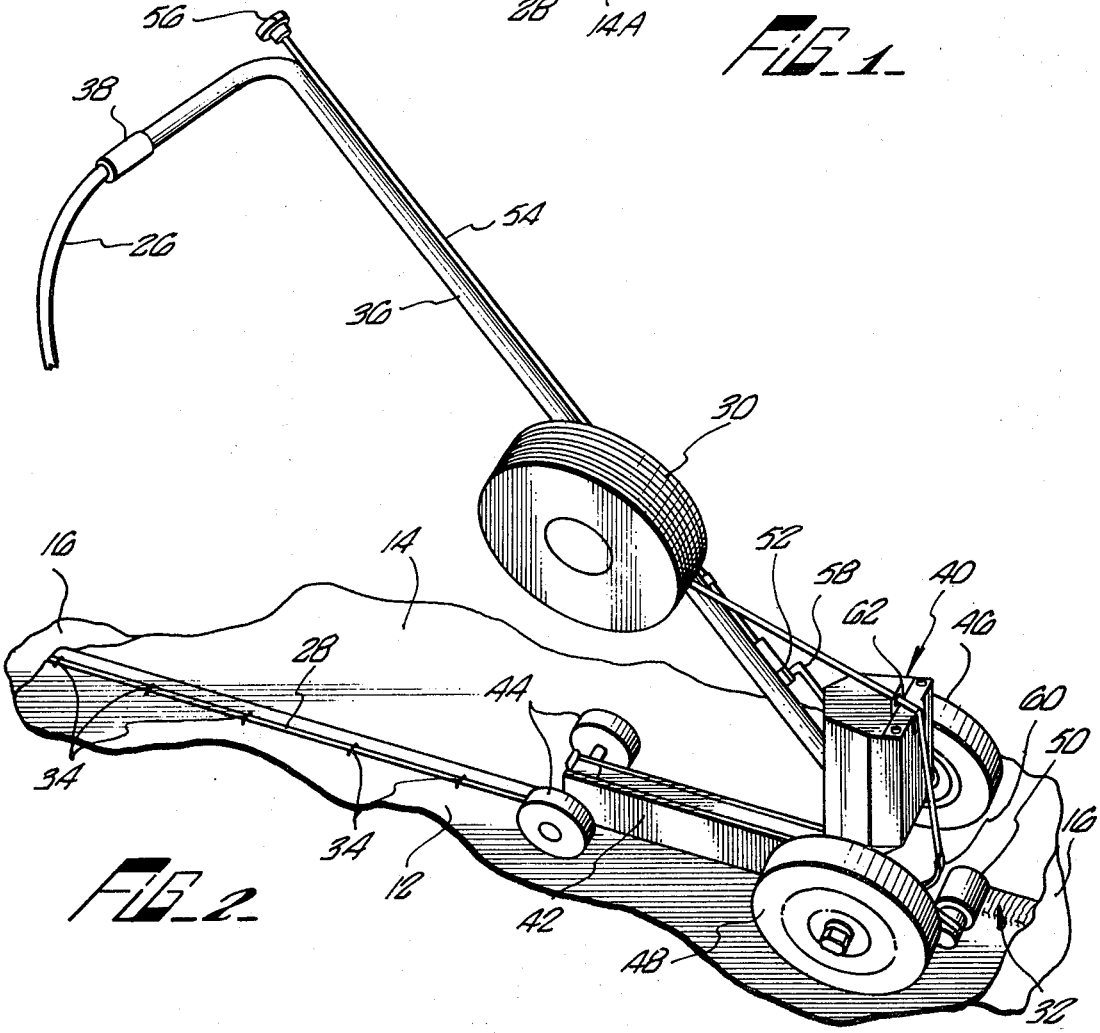
FIG. 2 is a view of the apparatus of the present invention, in its preferred embodiment, and illustrating in greater detail the application of tape according to the method of the present invention to produce the product thereof.

In FIG. 2, the tape stapler 20 is shown in greater detail. In addition, FIG. 2 illustrates the overlapping of the adjacent sheet materials 12 and 14 to produce a raised overlap 32, onto which the tape 28 from the roll of tape 30 is unrolled immediately prior to stapling. In FIG. 2, staples 34 are shown as enclosing the tape 28 and passing through the overlap 32 of the sheets so as to extend into the base 16.

The tape stapler 20 consists generally of a frame having a tubular handle 36, to the end of which the compressed air transfer hose 26 is connected by a coupling 38. The compressed air may then pass through the tubular handle 36 for application to a stapling machine 40, so as to actuate the stapling machine to drive the staples 34. A staple magazine 42 contains a supply of staples and is of conventional construction, as is the stapling machine 40 itself. Such are described, for example, in U.S. Pat. No. 3,200,716, issued Aug. 17, 1965, C. V. LeSage, inventor.

The frame includes a pair of rear wheels 44 which are mounted to the staple magazine 42 so as to support the rear end thereof. A left front wheel 46, a right front wheel 48 and a guide roller 50, in addition to the rear wheels 44, are included in the frame and ridge along the sheet material. The purpose of the guide roller 50 will be described further hereinafter.

A compressed air control valve 52, has an elongated actuator arm 54 terminating in an actuator knob 56. As will be apparent, the actuator knob is immediately adjacent the hands of the operator 10 when the apparatus is in operation. The compressed air control valve 52 is of conventional construction, such that pushing on the actuator knob 56 will open the valve, so as to permit compressed air contained in the tubular handle 34 to pass through the compressed air control valve 52 and into a compressed air transfer hose 58 for application to the stapling machine 40. While the compressed air control valve may, if desired, be used to trigger the stapling machine, in the preferred embodiment illustrated, the stapling machine is actuated by operation of an actuator valve, hereinafter described, when the compressed air control valve has been opened to supply compressed air to the stapling machine.

The frame has a tape guide 60 attached thereto, through which tape from the tape coil 30 passes. A secondary tape guide 62 is attached to the stapling machine 40 to provide for initial centering of the tape as it leaves the coil 30 and proceeds through the tape guide 60. The disposition of the tape guide 60, with respect to the stapler head of the stapling machine and the sheet material, will be described hereinafter in greater detail with respect to FIG. 4.

FIG. 3 is a front elevation of the stapling machine 40 and associated components, illustrating in greater detail the attachment of the wheels 46, 48. The left front wheel 46 is attached to the frame by means of a left front wheel mounting bracket 64, through which a threaded axle 66 extends. The wheel 46 is mounted on the threaded axle 66 and held in position by a pair of axle nuts 68. The left wheel mounting bracket also supplies a rigid mounting for the base of the tubular handle 36. The tubular handle base is sealed by means of a base plate (see FIG. 5) which is attached to the left front wheel mounting bracket 64 by three bolts 70. The right front wheel 48 is attached to a right front wheel axle 72 by an axle nut 74. The right front wheel axle 72 is fixed to a wheel lever arm 76. The wheel lever arm 76 is pivotally attached to a right front wheel bracket 78 by a threaded pivot bolt 80 and nut 82 and separated from the bracket 78 by a pivot washer 84. If desired, the brackets 64, 78 may be made as a single, unitary structure. The guide roller 50 is mounted on a guide roller axle 86 by a nut 88. The guide roller axle 86 is attached to the right wheel lever arm 76. The guide roller 50 is separated from a lever arm extension 90 and the nut 88 by a pair of washers 92.

FIG. 4 is a side elevation of the right front wheel 48 and right wheel lever arm 76. As will be seen in FIG. 4, the tape guide 60 receives the tape 28 and guides the tape in a tangential relation with the surface on which the tape stapler 20 rests. FIG. 4 also illustrates the relationship between the guide roller 50, and right wheel lever arm 76, and the right wheel 48, with respect to the stapler 20. As will be apparent from FIG. 4, when the guide roller 50 rises, the lever arm 76 pivots, forcing the right wheel 48 downward, so as to raise the stapling machine 40 slightly from the position shown in FIG. 3. Conversely, when the guide roller 50 lowers from the position shown in FIG. 3, the right wheel 48 rises from the position shown in FIG. 3, and the stapling machine 40 is slightly lowered from the position shown in FIG. 3.

Figure 5:
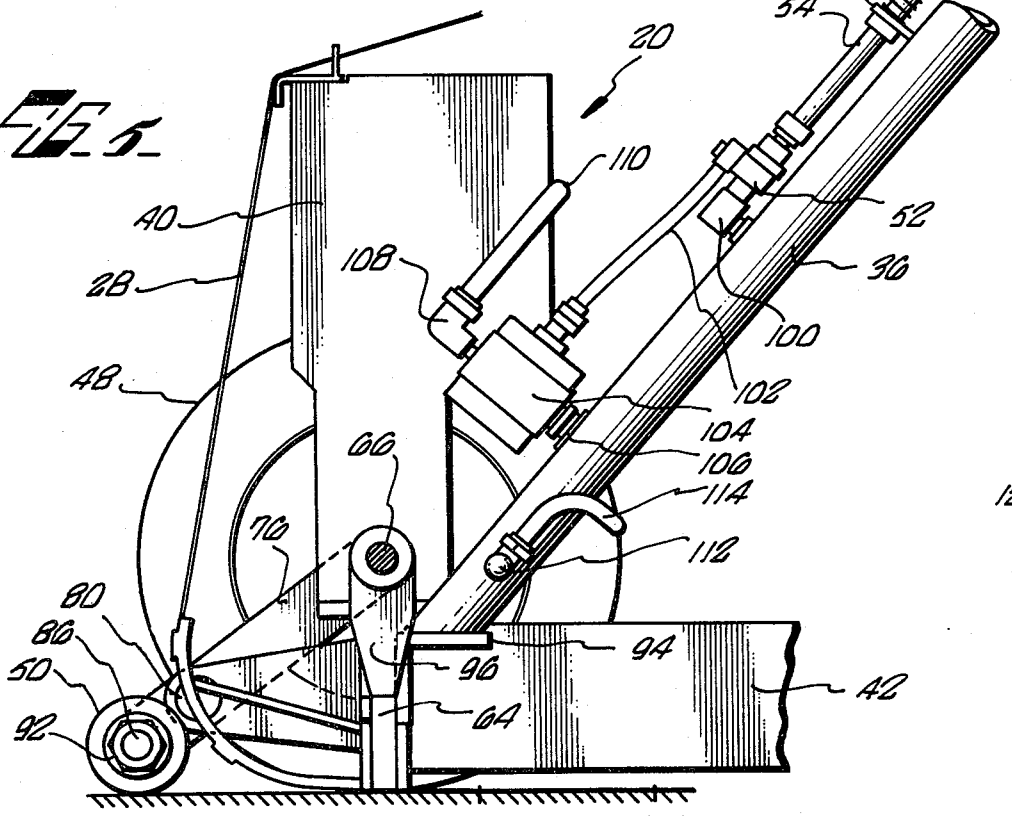
FIG. 5 is a view, partially in section, taken along lines 5—5 of FIG. 3.

Referring now to FIG. 5, a view, partially in section, taken along lines 5—5 of FIG. 3, again illustrates the relationship between the guide roller 50, right wheel lever arm 76, right wheel 48, stapling machine 40 and magazine 42. In addition, in FIG. 5, the means for attachment of the tubular handle 36 to the stapling machine 20 is illustrated. The tubular handle 36 is sealed at its base to hold the compressed air in the handle 36 by means of a base plate 94 which is attached by the bolts 70 (not shown, see FIG. 3) to the left front wheel mounting bracket 64. The left front wheel mounting bracket 64 also has an axle support arm 96, shown more clearly in FIG. 5, through which the threaded axle 66 extends.

Compressed air, contained in the tubular handle 36, is sealed within the handle by the base plate 94. The elongated actuator arm 54 is mounted on the tubular arm 36 by means of a mounting bracket 98 and normally biased so as to close the control valves 52 by a bias spring 98A. When the control valve 52 is opened by depression of the elongated actuator arm 54, the compressed air from the tubular handle 36 passes through a control valve inlet coupling 100, the control valve 52, and a control valve outlet connector 102 to actuate a normally closed compressed air inlet valve 104. Compressed air contained in the tubular handle 36 is applied to the normally closed inlet of the compressed air supply valve 104 through a supply valve inlet coupling 106. When the compressed air supply valve 104 is opened, the compressed air from the tubular handle passes through the valve inlet coupling 106, the compressed air supply valve 104, a compressed air supply valve outlet coupling 108 and a stapling machine compressed air supply coupling 110, in order to provide the compressed air necessary for stapling machine 40 operation.

Actuation of the stapling machine 40 is accomplished by application of pulses of compressed air, generated by means of an actuator valve 112, which is normally closed, and which, when opened, supplies compressed air from the tubular handle 36 to an actuator coupling 114. The actuator coupling 114 is connected to the stapling machine by any conventional method, appropriate for the particular type of stapling machine being utilized, in order to apply compressed air to the appropriate location in the stapling machine to initiate a stapling operation. By way of example, the stapling machine shown in U.S. Pat. No. 3,200,716, may be utilized, in which event the actuator valve 112 is a mechanical equivalent of, and replaces, the trigger assembly shown therein, so that the compressed air pulse provided by actuation of the actuator valve 112 corresponds to the compressed air pulse generated by the trigger assembly to initiate a stapling operation.

Figure 6:
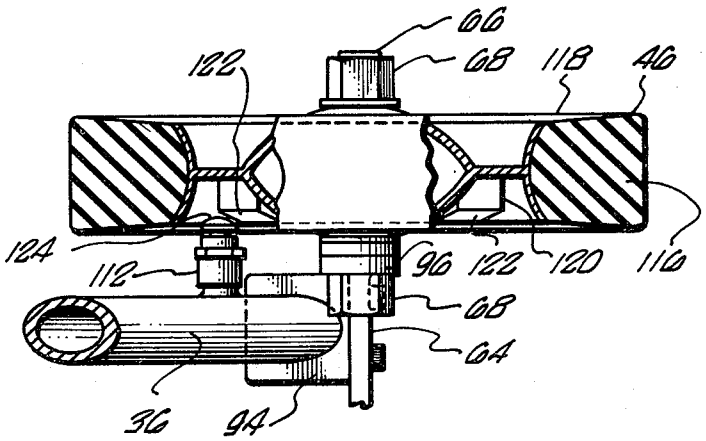
FIG. 6 is a view, partially in section, taken along lines 6—6 of FIG. 3.

FIG. 6 is a view taken along lines 6—6 of FIG. 3, partially in section, to illustrate the relative disposition of the actuator valve 112 with respect to the tape stapler 20. For purposes of clarity, the actuator coupling 114, shown in FIG. 5, is not shown in FIG. 6. The left front wheel 46 is shown partially in section, and has a tire 116 mounted on a wheel rim 118. Also mounted on the wheel rim 118 is an actuator block 120, of arcuate configuration, which has a sloping face 122 at each end thereof. The actuator block 120 is attached to the wheel rim 118 by bolts (not shown, see FIG. 8). The actuator valve 112 has an actuator button 124 extending outwardly therefrom toward the wheel rim 118. Compression of the actuator button 124 opens the actuator valve 112, so as to permit the passage of compressed air from the tubular handle 36 through the actuator valve 112 and into the actuator coupling 114. Rotation of the wheel 46 moves the actuator block 120 toward the actuator valve 112, causing the actuator button 124 to engage the sloping face 122. When the sloping face 122 depresses the actuator button 124 sufficiently, the actuator valve 112 opens.

Figure 8:
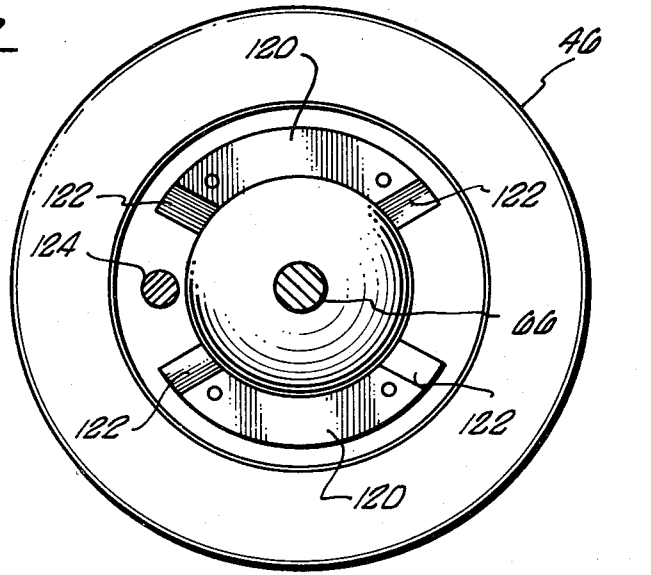
FIG. 8 is a view taken along lines 8—8 of FIG. 3.
Figure 7:
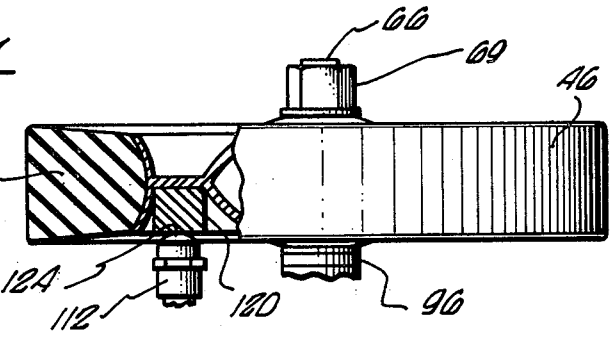
FIG. 7 is a view, partially in section, generally similar to FIG. 6 but illustrating a different disposition of the components shown therein.

FIG. 7 is a view, similar to FIG. 6, but illustrating the actuator valve with its actuator button depressed by the actuator block 120. FIG. 8 is a view, taken along lines 8—8 of FIG. 6, illustrating the wheel 46 in its preferred embodiment, as having two actuator blocks 120. FIG. 8 shows the actuator button 124 and the actuator blocks 120 in the disposition shown in FIG. 6.

FIG. 9 is a view, partially in section, illustrating in greater detail the relationship between the stapling machine 40 and the guide 60 with respect to the sheet material 12 and base 16 at the point of stapling. The stapling machine 40 has a stapler head 126. The stapler head has a cylindrical body portion 128 within which the drive piston (not shown) reciprocates. A drive blade 130, attached to the drive piston passes into a nose portion 132 of the stapler head 126. The nose portion 132 is attached to the stapler head 126 by a bolt 134 and to the magazine 42 by additional bolts (not shown). As will be apparent, the stapler head shown in FIG. 9 conforms generally to the stapler head of the device shown in FIG. 1 of the aforesaid U.S. Pat. No. 3,200,716. However, the tape guide 60 has been added by means of a mounting bracket 136 and support arm 138. The mounting bracket 136 is bolted to the nose portion 132 by means of bolts 140. As will be seen in FIG. 9, the tape guide 60 terminates adjacent the drive blades 130, so that the tape 28, as it passes over the tape guide 60, initially contacts the sheet material 12 immediately adjacent the point of stapling, which is defined by the point at which the drive blade is actuated as as to drive one of the staples 34 from the magazine 42 through the sheet material into the base 16.

Figure 10:
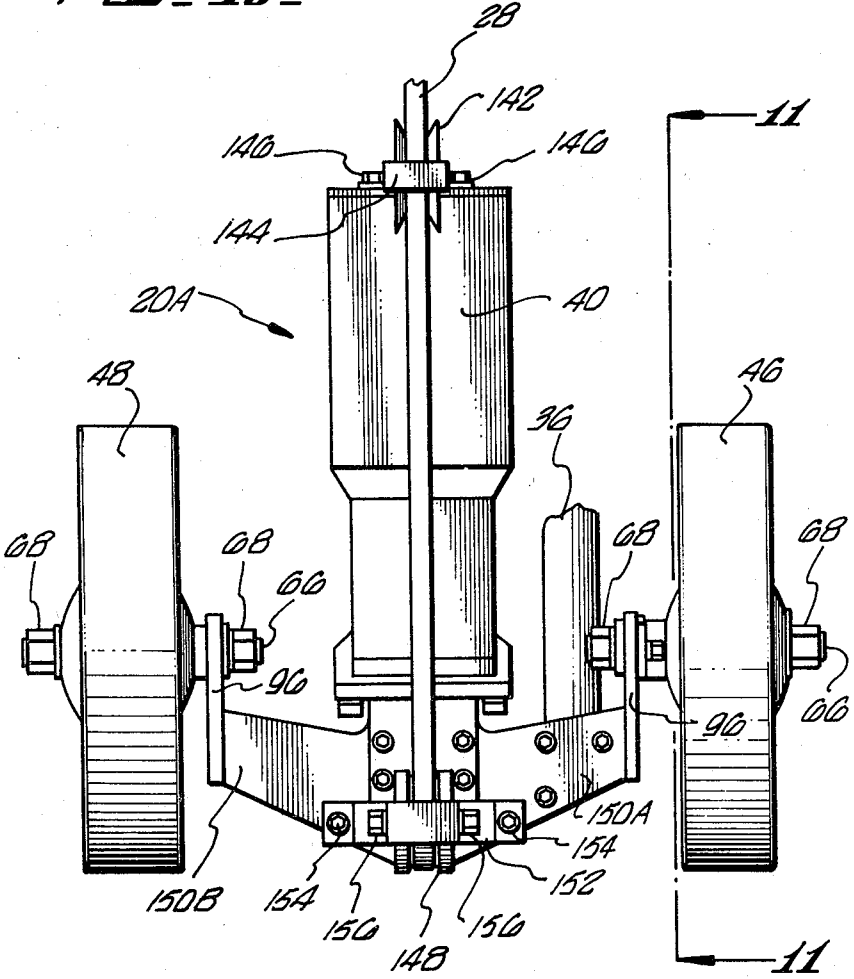
FIG. 10 is a front elevation of an alternate embodiment of the apparatus of FIG. 3.

FIG. 10 is a front elevation of a tape stapler 20A illustrating an alternate embodiment of the present invention. In FIG. 10, tape 28 from the tape stapler 20A passes over a guide wheel 142, which is held in position by a mounting bracket 144 attached to the stapling machine 40 by bolts 146. After passing over the tape guide wheel 142, the tape 28 passes over a tape feed wheel 148. In the embodiment of FIG. 10, the tape stapler 20A has a pair of wheel mounting brackets 150A, 150B, which, if desired, may be combined as a single unitary structure. The wheel mounting bracket 150A is generally similar to the left front wheel mounting bracket 64 of the first embodiment. The wheel mounting bracket 150B is the general mirror image of the wheel mounting bracket 150A. The wheels 46, 48 are mounted to the wheel mounting brackets 150A, 150B in the same manner as the wheel 46 was mounted on the left front wheel mounting bracket 64 in the prior embodiment, and like numbers are therefore used to designate the components. The tape feed wheel 148 is attached to the wheel mounting brackets 150A, 150B by means of a tape feed wheel support 152 and bolts 154. The tape feed wheel 148 proper being mounted on an axle formed by a bolt 156 which extends through the feed wheel support 152 and which is held in place by a nut 158.

Figure 11:
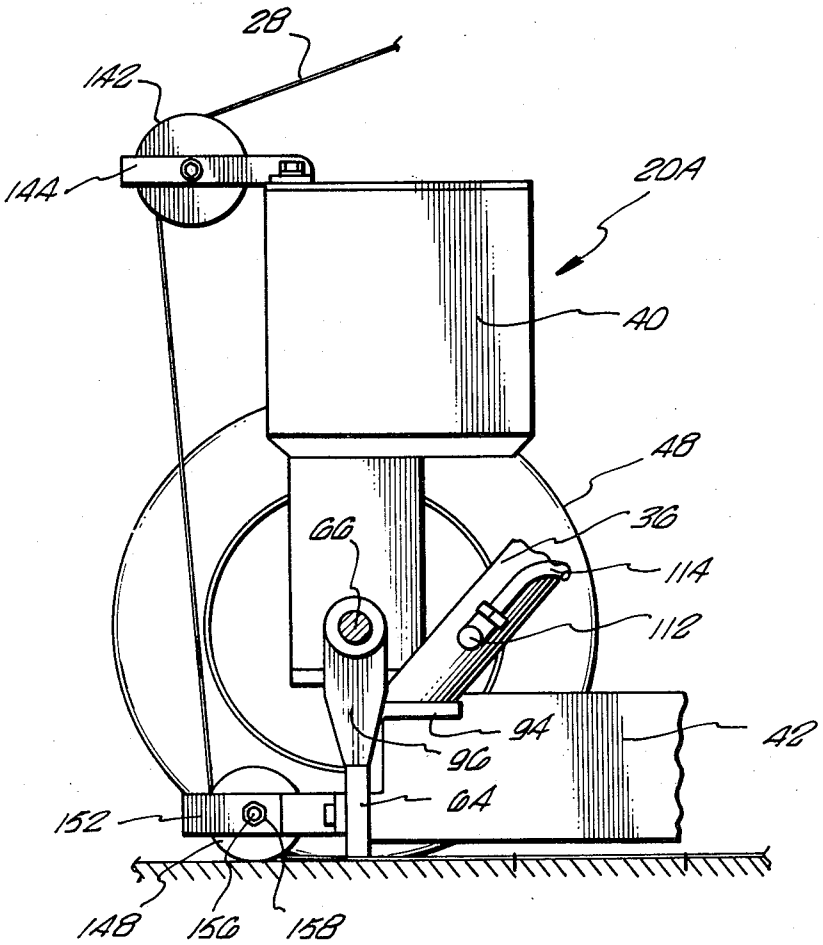
FIG. 11 is a view taken along lines 11—11 of FIG. 10.

FIG. 11 is a view taken along lines 11—11 of FIG. 10, illustrating the general arrangement of the tape feed system of the alternate embodiment with respect to the tape stapling machine 40. The stapling machine 40 is actuated in the same manner as was described heretofore with respect to the first embodiment. As will be noted from FIG. 11, the tape makes initial contact with the sheet material 12 upon which the tape stapler rests immediately adjacent the stapler head of the stapling machine.

The alternate embodiment of tape stapler shown in FIGS. 10 and 11 operates generally in the same manner as that heretofore described with respect to FIGS. 1 through 9. The stapling machine has a stapler head under which the tape 28 is passed, and stapling is initiated and compressed air supplied in the same manner as heretofore described.

FIG. 12 is a view, in section, illustrating the product of the method and apparatus of the present invention. In FIG. 12, the staple 34 is shown as enclosing the tape 28 and passing through an overlapping seam between sheet material 12 and sheet material 14, so as to hold the two pieces of sheet material 12, 14 together and to extend into the base 16. Thus, the tape 28 and sheet material 12, 14 are attached firmly to the base 16 by means of the staple 34. When additional fastening of the sheet material to the base is required between overlapping seams, the product of the present invention would consist solely of a single sheet, either sheet 12 or 14, through which the staple 34 has been driven and against which the tape 28 is held by the staple.

By using the long continuous strips of tape to hold the sheet material to the base by the present invention, rather than separate individual discs or equivalent materials which are individually fastened through the sheet material to the base, as is the practice in the prior art, the sheet material is more firmly fastened to the base. Thus, it has been found that the tape itself, intermediate of the staples, exerts a fastening or holding effect upon the sheet material, so as to inhibit tearing of the sheet material from the base.

In order to more clearly set out the method and product aspects of the present invention, the operation of the apparatus of the present invention will be summarized with respect to the two described embodiments. As will be apparent, the difference between the two embodiments is the apparatus by which the tape is passed under the stapler head so that the staple is driven at or immediately adjacent the point of contact of the tape with the sheet material. In the first embodiment, a rigid tape guide is used, while in the second embodiment a freely rotatable tape feed wheel is used. In both embodiments, it is extremely important that the stapler head, and consequently the tape as it passes under the stapler head, be kept immediately adjacent the sheet material. The structural differences between the two embodiments provide two different types of apparatus for insuring this adjacency.

In normal operation, if it could be assured that the sheet material and base were comparatively smooth, so that no bumps or dips existed, insuring that the tape contacted the sheet material at a point in close proximity to the stapler head would be relatively simple. However, in actual practice, bumps, ridges, dips and other surface irregularities exist. If the stapler head is mounted so as to be fixed in position only slightly separated from the sheet material, an irregularity in the sheet material which rises above the termination of the stapler head will cause the movement of the tape stapler along the sheet material to be stalled when the stapler head contacts the irregularity. Because of the four-wheeled rigid base structure tape stapler provided generally by the magazine, the tape stapler is not readily tilted upwardly at its front to clear such obstructions. In order to avoid such stalling of the tape stapler in the first embodiment, the guide roller 50, when it encounters such an obstruction, rises, and by reason of the lever arm involved, forces the right front wheel 48 downwardly, so as to slightly raise the stapler head. It will be apparent that the relative lengths of the lever arms involved in mounting the guide roller and the right front wheel are proportioned to clear such obstructions as will normally be encountered. In the first embodiment, if a dip in the surface is encountered, the guide roller will lower, raising the right front wheel 48 and lowering the stapler head so as to continue the close adjacency of the stapler head and the sheet material.

In contrast to the first embodiment, which provides for compensating movement of the stapler head to maintain close adjacency with the sheet material for either type of irregularity in the sheet material or base while preventing stalling of the tape stapler movement, the second embodiment only provides for upward movement of the stapler head in order to avoid stalling of the tape stapler when it encounters ridges or bumps in the surface. When such a ridge or bump is encountered, the tape feed wheel 148 rides over the discontinuity, so as to raise the tape stapler head and permit clearance of the stapler head. For a very narrow abrupt bump, the second embodiment may stall, whereas the first embodiment, because of the curved staple guide, would permit the tape stapler to be readily pushed over the bump. Nor does the second embodiment provide for stapler head position compensation for dips.

Upon initiating the stapling operation, tape from the coil is fed past the stapler head, and the tape stapling machine is actuated, so as to fasten the tape to the base and sheet material. The tape stapler is then rolled along the sheet material, the tape stapler being periodically automatically actuated by means of the actuator block 120 and actuator valve 112. Such an operation, in its method, generally comprises laying a continuous strip of tape along the base and the sheet material so as to rest on the sheet material and periodically driving staples which laterally enclose the strip of tape through the sheet material into the base substantially contemporaneously with the initial contact between the strip of tape and the sheet material at each point of stapling.

In the particular configurations shown for the tape staplers, 20, 20A, the tape is in the form of a coil which is mounted on an axle, core, or the like, so as to be rotatably attached to the handle 36. Thus, the coil of tape is free to rotate, so as to pay out the tape as required. The tape is paid out by being pulled by means of the last applied of the staples 34, which fasten the tape to the sheet material and base. While, in the embodiments referred to above, a coil of tape is utilized, it will be understood that any source of a continuous strip of tape may be utilized, so long as the tape may be freely fed to a point adjacent the stapler head for stapling to the sheet material and base.

In actual operation, various types of stapling may be utilized. For example, the staples may be driven at an angle of 25° to 30°, or the staples may be driven vertically. If driven vertically, the staples may have divergent ends, if desired. The particular holding capacity associated with the product of the present invention will vary somewhat depending upon the type of stapling operation utilized. In addition, the holding capacity will vary greatly, depending upon the material which constitutes the base. Typically, the base material may be gypsum concrete, wood, or zonolite. The use of zonolite greatly reduces the holding capacity of the product of the present invention with respect to the holding capacity exhibited if wood or gypsum is used. The sheet material utilized may be any of the large number of commercially available sheet materials, which may vary from simple treated roofing paper to asphalt felt type sheet materials. The base material may also, for example, be metal, and it is therefore understood that the terms base material and sheet material, as used herein, are to be interpreted as generic to these types of materials, and not limited to any particular composition or combination of compositions.

By way of example, one series of tests show the following results with respect to the vertical pull out loads. In the tests, roofing felt was attached to gypsum concrete by using the staple and tape combination of the present invention, and by using the conventional practice of driving nails through discs. The felt samples were approximately one square foot in size. In attachment by staple and tape, two 2 inch staples were applied to each of two lengths of tape, of approximately three-eighths inches in width, so as to hold the felt to the gypsum concrete. The nails and discs were similarly situated. After attachment, by staples or nails, hot roofing asphalt was poured over the test space and a plywood panel imbedded therein. Loads were applied vertically to the center of the plywood and the force necessary to extract the plywood asphalt felt section from the gypsum concrete were determined. The staples were driven at an angle of about 25°. The tests showed that the force required to separate the plywood asphalt felt section from the gypsum concrete, for the staple and tape combination, exceeded the force required to separate the plywood asphalt felt section from the gypsum concrete for the nail and disc combination, by from 160 to over 200 percent. Furthermore, it has been found that, by using the staple and tape combination of the present invention, the labor time required for attachment of comparable areas of sheet material to a base may be reduced as much as 80 percent over the labor time required for attachment by using the manually driven nail and disc combination of the prior art.

Various types of tape may be utilized in the practice of the present invention. Presently preferred, however, is a rayon cord tape, of three-eighths inches in width, consisting of five parallel aligned tape elements attached together by means of an adhesive, and manufactured by the American Viscose Division of FMC Corporation under the tradename Avis Strap (30-L). This tape has a tensile strength of 325 pounds, elongation of 12 percent, recovery of 95 percent, an energy to break of 17.7 pounds per inch, and a flash point in excess of 800° Fahrenheit.

Typically, sheet material is in 36 inch widths. When the base consists of wood, it has been found preferable in the practice of the invention to utilize two strips of tape for each strip of sheet material, one laid upon the overlapping of the sheet with the adjacent sheet, and the other laid along the middle of the strip of sheet material, with staples driven with a 12 inch spacing. When the base material consists of gypsum concrete, it has been found preferable to use three strips of tape per strip of sheet material, with the same 12 inch staple spacing. With zonolite, it has been found preferable to use three strips of tape, with an 8 inch staple spacing.

We claim:

1. The method of attaching roofing sheet material to a roof including the steps of providing a moveable frame having attached thereto (a) a continuous strip of flat, flexible, nonmetallic tape formed into a coil so as to be rotatable about the coil axis and (b) a stapling machine having a stapler head and passing a continuous strip of the flat, flexible nonmetallic tape from said coil beneath the stapler head;

disposing the frame of the sheet material so that the stapler head and strip of flat, flexible, nonmetallic tape are immediately adjacent the sheet material;

moving the frame, while so disposed, along the roof while continuously monitoring the contour of the roof portion over which said frame is moved by providing a lever pivotally attached to the stapler head and having a support wheel at one end thereof and a guide roller at the opposite end thereof which contacts the roof, adjusting the position of said stapling machine by pivoting said support wheel relative to said stapling machine in response to movement of said guide roller as it monitors the contour of the roof, periodically actuating the stapling machine to staple the flat, flexible nonmetallic tape to the base through the sheet material; and continuously pulling the tape from the coil by means of the successively last applied staple as the frame is moved along the sheet material during the periodic stapling.

* * * * *